US005277430A

United States Patent [19]

Naccarato

[11] Patent Number: 5,277,430

[45] Date of Patent: Jan. 11, 1994

[54] FREE HANGING PRACTISE GOAL NET

[76] Inventor: Peter Naccarato, 61 Glenthorne Dr., Scarborough, Ontario, Canada, M1C 3S9

[21] Appl. No.: 992,751

[22] Filed: Dec. 18, 1992

[51] Int. Cl.[5] ..... A63B 63/04

[52] U.S. Cl. ..... 273/400; 273/57.2

[58] Field of Search ..... 273/400, 57.2, 398

[56] References Cited

U.S. PATENT DOCUMENTS

| | | | |
|---|---|---|---|
| 3,215,432 | 11/1965 | Lee | 273/401 X |
| 3,840,228 | 10/1974 | Greaney | 273/57.2 |
| 3,887,181 | 6/1975 | Samaras | 273/57.2 |
| 4,057,252 | 11/1977 | Pelton | 273/400 |
| 4,492,380 | 1/1985 | Saytar | 273/411 |
| 4,579,344 | 4/1986 | Meggs | 273/411 X |
| 4,796,886 | 1/1989 | Loh | 273/401 X |

FOREIGN PATENT DOCUMENTS

| | | | |
|---|---|---|---|
| 1140180 | 1/1983 | Canada | 273/57.2 |

*Primary Examiner*—William H. Grieb

[57] ABSTRACT

A free hanging practice goal structure for recreational use in practicing games such as hockey in front of a domestic garage having a door opening, and comprising, generally a three sided rectangular frame comprising side members and a cross member, meeting at corners, flexible panels secured to the side members, and the top member, and the panels being secured to a large back panel which is adapted to be secured to structure around the garage door opening, and to at least substantially close it, junctions joining the flexible panels to the back panel, so that lower ends of the flexible panels are located adjacent the grade level adjacent the garage door, and, fastenings for fastening the back panel to structure around the garage door opening.

9 Claims, 1 Drawing Sheet

FREE HANGING PRACTISE GOAL NET

FIELD OF THE INVENTION

The invention relates to a home practise goal net for practising games such as hockey in a driveway, and in particular to such a net which is adapted to be suspended in front of a garage door, and which may be easily dismantled and stored.

BACKGROUND OF THE INVENTION

Young persons frequently wish to practise hockey or other games in a domestic location. Typically this will be on a paved surface, to as far as possible simulate an ice surface, since the grass in the backyard would be unsuitable.

In the vast majority of cases such young persons will practise hockey actually in the driveway in front of their homes.

In many cases the goal is designated as the garage door, and three or four players will take turns at taking shots at the garage door goal. A goal keeper may be placed in front of the garage door to practise goal saving shots.

In hockey as usually practised in this way a playing element, either is used, a genuine hockey puck, or a softer rubber form of hockey puck, or, in many cases a used tennis ball.

In all cases where the element strikes the garage door it will be hitting a hard surface and will rebound with considerable force. This rebound will then cause the playing element to run down the driveway and out into the road. This frequently causes hazardous situations for the young persons practising hockey. It also causes great alarm to drivers who happen to be passing by and see a ball or puck flying out of the driveway.

The immediate reaction of such a driver is to stop his vehicle in an emergency stop. This in turn may cause the vehicle following him to have a rear end collision. On the other hand if he does not make a crash stop, then the driver runs the risk that a young person will run out unexpectedly in front of him and be injured.

A second although somewhat less hazardous result is caused by such hockey practise against a garage door. Every time a black hockey puck strikes the garage door it will leave a black mark. Even a tennis ball, which is usually dirty will leave some kind of a dirt mark. As a result, the garage door will become covered with unsightly marks where the puck or ball has struck it. The house holder will thus have to repaint the garage frequently in order to maintain the appearance of his home. Doors may in some cases be damaged by repeated impacts. Raising the door will solve the particular problem. However, young persons would not be willing to accept this disadvantage. Also an automobile, or items within the garage would then be damaged.

The third disadvantage of this situation is that since the garage door is located behind the goal keeper it is sometimes difficult to as it were "keep score". There may be arguments or disputes as to whether the goal keeper actually saved the shot or whether it actually passed him and entered the goal.

For all of these reasons therefore it is clearly desirable to provide some form of safer hockey practise net for use at the home which both reduces the rebound effect, and which also prevents damage to the paint work on the garage door. Desirably such a practise net will more closely simulate the actual appearance of a hockey net, so that there may be fewer disputes as to whether a goalie made a save or missed it.

BRIEF SUMMARY OF THE INVENTION

With a view to providing a solution to the various foregoing conflicting problems noted above, the invention comprises a free hanging practise goal net for recreational use in practising games such as hockey in front of a domestic garage having a garage door opening and structure partially surrounding the same, and comprising a generally three sided rectangular frame means comprising side members having upper and lower ends and an upper cross member, meeting at corners, flexible panel means secured to said side member, and said top member, back panel means adapted to be secured to said structure around said garage door opening, and to at least substantially close the same, junction means joining said flexible panel means to said back panel means, whereby lower portions of said flexible panel means are located adjacent the grade level adjacent the garage door opening, and, fastening means for fastening said back panel means to said structure around said garage door opening, whereby said frame means will be flexibly supported by said flexible panel means with said upper and side cross members spaced from said back panel means.

The invention further comprises such a free hanging practise goal net structure and wherein said garage door opening has a predetermined width and height, and wherein said back panel means has a predetermined width and height substantially corresponding to said garage door width and height, whereby said back panel means will substantially close off said garage door opening.

The invention further comprises such a free hanging goal net including said flexible side panel means, and flexible top panel means, secured to said back panel means in a central lower area thereof, whereby lower side edges of said side panel means, and lower ends of said three sided rectangular frame means are adapted to lie at grade level adjacent said garage door opening.

The invention further comprises such a free hanging practise goal net wherein said side panel means have upper and lower ends, and wherein said upper ends have a predetermined width, greater than the width of said lower ends, whereby to define a generally quadrilateral shape in side elevation, and wherein said flexible top panel means has a predetermined width equal to the width of the said upper ends of said side panel means, whereby said rectangular frame means may adopt a forward means, whereby said rectangular frame means may adopt a forward leaning angle relative to said back panel means.

The invention further comprises such a free hanging practise goal net including foot members at the lower ends of said three sided rectangular frame means, for standing on the ground adjacent said garage door opening.

The invention further comprises such a free hanging practise goal net, and wherein said three sided rectangular frame means comprises right and left side members, and a generally horizontal top member, all of said side members and top member being formed of generally cylindrical hollow plastic pipe material, and generally radiused corner portions joining the upper ends of said side members with opposite ends of said top member.

The invention further comprises such a free hanging practise goal net, and wherein said flexible side panel means are folded around said respective side members, and are sewn to form sleeve-like junctions with said side members, and wherein said top panel means is folded around said top member of said frame means, and is seamed to form a sleeve therearound.

The invention further comprises such a free hanging practise goal net for recreational use in practising games such as hockey in front of a domestic garage having a garage door opening and structure partially surrounding the same, and comprising a generally three sided rectangular frame means comprising side members having upper and lower ends and an upper cross member, meeting at corners, flexible side panel means secured to said side members, flexible top panel means secured to said top member, said side panel means meeting said top panel means adjacent said corners, back panel means adapted to be secured to said structure around said garage door opening, and to at least substantially close the same, junction means joining said side panel means and said top panel means to said back panel means, whereby said lower ends of said flexible side panel means are located adjacent the grade level adjacent the garage door opening, fastening means for fastening said back panel means to said structure garage door opening, whereby said frame means will be flexibly supported by said side panel means with said upper and side cross members spaced from said back panel means, and, said flexible side panel means are folded around said respective side members, and are sewn to form sleeve-like junctions with said side members, and wherein said top panel means is folded around said top member of said frame means, and is seamed to form a sleeve therearound.

The invention further comprises a free hanging practise goal net for recreational use in practising games such as hockey in front of a domestic garage having a garage door opening and structure partially surrounding the same, and comprising a generally three sided rectangular frame means comprising side members having upper and lower ends and an upper cross member, meeting at corners, flexible side panel means secured to said side members, flexible top panel means secured to said top member, said side panel means meeting said top panel means adjacent said corners, back panel means adapted to be secured to said structure around said garage door opening, and to at least substantially close the same, junction means joining said side panel means and said top panel means to said back panel means, whereby said lower ends of said flexible side panel means are located adjacent the grade level adjacent the garage door opening, fastening means for fastening said back panel means to said structure around said garage door opening, whereby said frame means will be flexibly supported by said side panel means with said upper and side cross members spaced from said back panel means, foot members at the lower ends of said three sided rectangular frame means, for standing on the ground adjacent said garage door opening, and, said flexible side panel means being folded around said respective side members, and sewn to form sleeve-like junctions with said side members, and wherein said top panel means is folded around said top member of said frame means, and is seamed to form a sleeve therearound.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

As mentioned above, the invention is directed specifically to the provision of practise hockey net for domestic use typically in a driveway in front of a garage door G.

Usually, around such a garage door there will be some form of structure such as wooden garage door frame work F which is part of the building fabric which defines the garage door opening. It provides suitable attachment points, in the manner to be described below.

Figure 1:
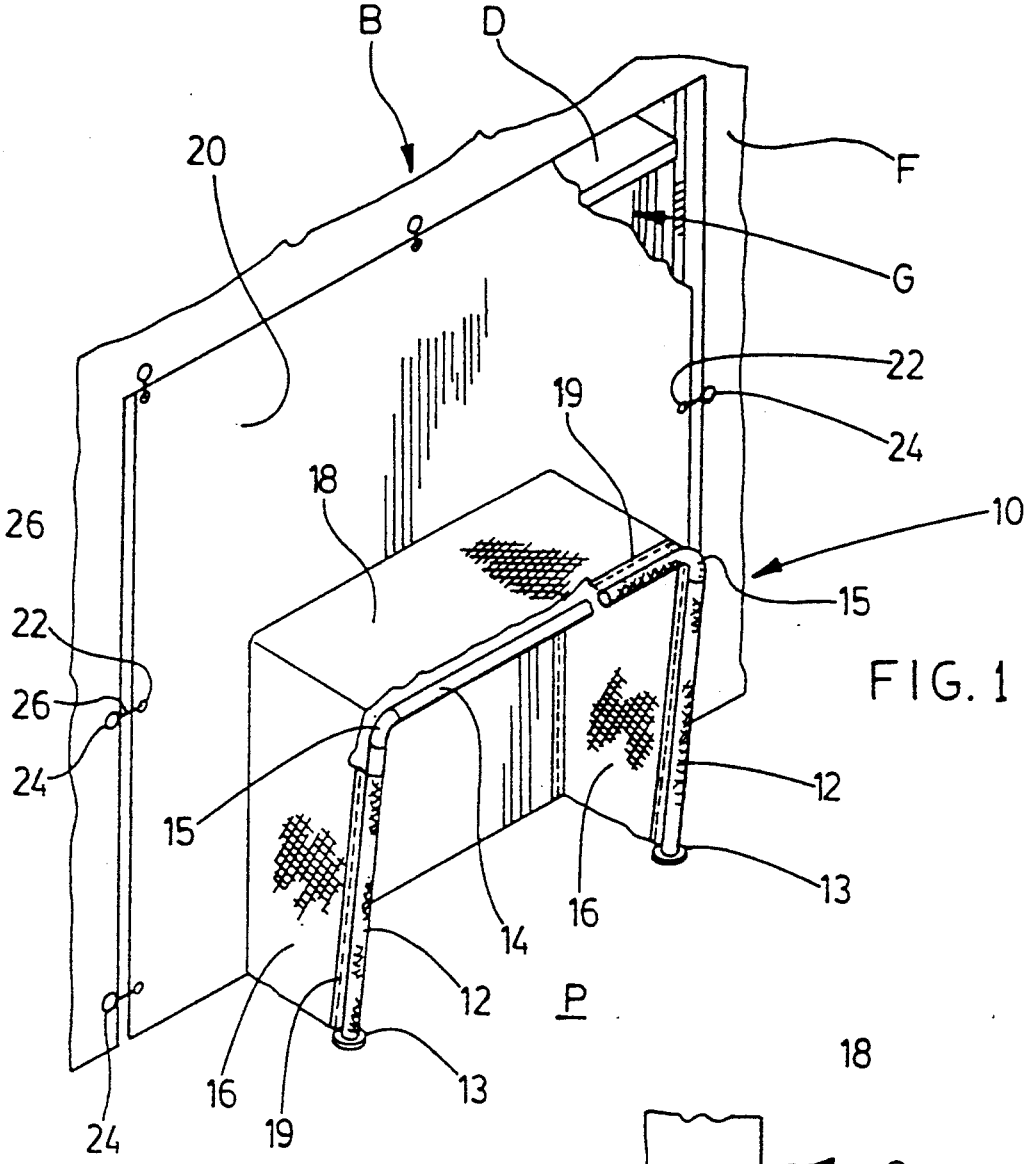
FIG. 1 is a perspective of a practice net in accordance with the invention.
Figure 2:
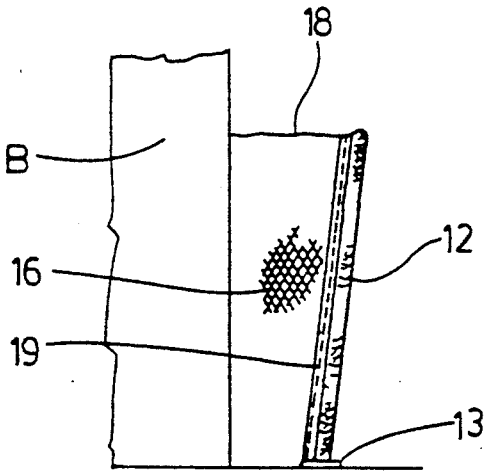
FIG. 2 is a side elevation of the net of FIG. 1 in an extended position.
Figure 3:
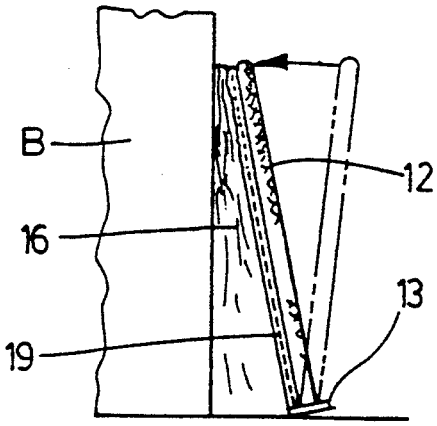
FIG. 3 is a side elevation similar to FIG. 2 shown a retracted position.

As shown in FIG. 1, such a building is indicated generally as B and a garage indicated as G, having a garage door D and a frame work structure F.

As stated, this is illustrated here merely by way of a typical example and without limitation. The garage may be formed as part of the house, or it may be erected separately from the house and the driveway may extend simply from the front of the house to the roadway, or the driveway may extend past the house to a garage which is located in the rear of the house. In some cases the garage may be located to one side, for example on the corner lot.

In any event, in the majority of such situations there will be a paved driveway indicated as P in front of the garage. In very many cases this paved driveway provides the only hard surface on which young persons can practise games such as hockey and the like since the grass surface of the reminder of the lot is too soft and too slow, and is unsuitable for practise of this kind. Again referring to FIG. 1, the practise hockey net will be seen to be indicated generally by the reference number 10.

It comprises a generally three-sided rectangular frame comprising two generally vertical side members 12—12 which may have feet 13, and having upper and lower ends and a horizontal upper cross member 14 joined thereto a two upper corners 15. There is no lower cross member.

The frame members 12—12 and 14 typically formed of any convenient material such as for example plastic plumbing pipe or the like.

In order to provide the sides and top of the net, a woven fabric material or synthetic plastic material, comprising side panels 16—16 and a top panel 18, are secured to the side frame members 12 and the top frame member 14 respectively by seams 19. In this embodiment it will be seen that the side panels 16—16 are preferably wider at the top and narrower at the bottom, in a tapering generally quadrilateral shape although this feature is not essential in all cases. Thus the side panels can simply be rectangular in many cases. The top panel 18 is of a generally rectangular shape, having a width equal to the upper portion of the side panels 16.

The entire net and framework are secured to a much larger fabric back panel 20. Typically, this fabric back panel will be of a woven synthetic material dipped in a thermoplastic material. A typical synthetic fabric tarpaulin is suitable. It will have fastenings or grommets 22 located at the four corners and at midpoints, for reasons to be described. Typically the panel 20 will be approximately the same size as the typical garage door opening of a single car garage. Around the frame work structure F of the garage door any suitable securing means are provided. In this case they may be screw in rings 24—24 screwed into the woodwork of the frame structure F, at points registering with the grommets or fastenings 22.

Panel 20 is of such a size and shape as to substantially fill the opening of the garage door.

Any suitable tensioning means such as rubber tensioners, strings, ropes or tapes 26—26 are used to secure the grommets to the rings.

In use, the garage door is raised out of the way. The panel 20 is then secured to the frame structure F by means of the ties or tapes 26, closing the opening left by the garage door. Preferably this will tension the panel 20 substantially flat.

This will then leave the net frame, consisting of the side members 12 and top member 14 essentially suspended or oriented in a flexible manner, preferably although not exclusively, in a forwardly angled position, in which it extends the side panels and top panel of the woven fabric, but is collapsible back against the back panel 20. There is no requirement for any rigid connection between the framework 12-14 and the panel 20, since once the framework is extended it will naturally extend the sides and top of the net.

It will thus be seen that when used by young persons, such a practise goal provides a particularly useful and enjoyable recreational device which at the same time reduces the hazards to a minimum. Thus for example if a young person should bump into part of the framework of the goal, it will simply give way and the side and top panels being flexible, will allow the frame to fold back against the panel 20. If a ball or puck is struck into the goal, it will not hit a hard object but will simply hit the flattened back panel 20 which will then absorb the momentum of the ball or pack, causing it simply to drop to the pavement without rebounding.

At the same time, since the garage door is out of the way, having been raised prior to the attachment of the panel 20, the garage door is not subject to repeated impacts of a ball or puck, which might damage the door and cause unsightly marks on the door. The back panel effectively prevents damage to items stored in the garage.

The foregoing is a description of a preferred embodiment of the invention which is given here by way of example only. The invention is not to be taken as limited to any of the specific features as described, but comprehends all such variations thereof as come within the scope of the appended claims.

I claim:

1. A free hanging practise goal net for recreational use in practising games such as hockey in front of a domestic garage having a garage door opening and structure surrounding the same, and comprising;

generally three sided rectangular frame means comprising side members having upper and lower ends and an upper cross member, meeting at corners;

flexible panel means secured to said frame means;

back panel means adapted to be secured to said structure around said garage door opening, and to at least substantially close the same;

junction means joining said flexible panel means to said back panel means, whereby lower ends of said flexible panel means are located adjacent the grade level adjacent said garage door opening, and, fastening means for fastening said back panel means to said structure around said garage door opening, whereby said frame means will be flexibly supported by said flexible panel means with said frame means spaced from said back panel means.

2. A free hanging practise goal net as claimed in claim 1 wherein said structure around said garage door opening has a predetermined width and height, and wherein said back panel means has a predetermined width and height substantially corresponding to said structure width and height, whereby said back panel means will substantially close off said garage door opening.

3. A free hanging goal net as claimed in claim 2 including flexible side panel means and flexible top panel means secured to said back panel means in a central lower area thereof, whereby lower side edges of said side panel means, and lower ends of said three sided rectangular frame means are adapted to lie at grade level adjacent said garage door opening.

4. A free hanging practise goal net as claimed in claim 3 wherein said side panel means have upper and lower ends, and wherein said upper ends have a predetermined width, greater than the width of said lower ends, whereby to define a generally quadrilateral shape in side elevation, and wherein said flexible top panel means has a predetermined width equal to the width of the said upper ends of said side panel means, whereby said rectangular frame means may adopt a forward leaning angle relative to said back panel means.

5. A free hanging practise goal net as claimed in claim 1 including foot members at the lower ends of said three sided rectangular frame means, for standing on the ground adjacent said garage door opening.

6. A free hanging practise goal net as claimed in claim 3, and wherein said three sided rectangular frame means comprises right and left side members, and a generally horizontal top member, all of said side members and top member being formed of generally cylindrical hollow plastic pipe material, and generally radiused corner portions joining the upper ends of said side members with opposite ends of said top member.

7. A free hanging practise goal net as claimed in claim 6, and wherein said flexible side panel means are folded around said respective side members, and are sewn to form sleeve-like junctions with said side members, and wherein said top panel means is folded around said top member of said frame means, and is seamed to form a sleeve therearound.

8. A free hanging practise goal net for recreational use in practising games such as hockey in front of a domestic garage having a garage door opening and structure surrounding the same, and comprising;

generally three sided rectangular frame means comprising side members having upper and lower ends and an upper cross member, meeting at corners;

flexible side panel means secured to said side members;

flexible top panel means secured to said top member, said side panel means meeting said top panel means adjacent said corners;

back panel means adapted to be secured to said structure surrounding said garage door opening, and to at least substantially close the same;

junction means joining said side panel means and said top panel means to said back panel means, whereby said lower ends of said flexible side panel means are located adjacent the grade level adjacent the garage door opening;

fastening means for fastening said back panel means to said structure around said garage door opening, whereby said frame means will be flexibly supported by said side panel means with said upper and side cross members spaced from said back panel means, and, said flexible side panel means being folded around said respective side members, and sewn to form sleeve-like junctions with said side members, and wherein said top panel means is folded around said top member of said frame means, and is seamed to form a sleeve therearound.

9. A free hanging practise goal net for recreational use in practising games such as hockey in front of a domestic garage having a garage door opening and structure surrounding the same, and comprising;

generally three sided rectangular frame means comprising side members having upper and lower ends and an upper cross member, meeting at corners;

flexible side panel means secured to said side members;

flexible top panel means secured to said top member, said side panel means meeting said top panel means adjacent said corners;

back panel means adapted to be secured to said structure around said garage door opening, and having predetermined a width and height adequate to at least substantially close the same;

junction means joining said side panel means and said top panel means to said back panel means, whereby said lower ends of said flexible side panel means are located adjacent the grade level adjacent said garage door opening;

fastening means for fastening said back panel means to said structure around said garage door opening, whereby said frame means will be flexibly supported by said side panel means with said upper and side cross members spaced from said back panel means;

foot members at the lower ends of said three sided rectangular frame means, for standing on the ground adjacent said garage door opening, and, said flexible side panel means being folded around said respective side members, and secured to form sleeve-like junctions with said side members, and wherein said top panel means is folded around said top member of said frame means, and is secured to form a sleeve therearound.

* * * * *